US007062800B1

(12) United States Patent
Alfred

(10) Patent No.: US 7,062,800 B1
(45) Date of Patent: Jun. 20, 2006

(54) PLUNGER

(76) Inventor: Benjamin Alfred, 2525 Church Ave. Apt D-8, Brooklyn, NY (US) 11226

( * ) Notice: Subject to any disclaimer, the term of this patent is extended or adjusted under 35 U.S.C. 154(b) by 0 days.

(21) Appl. No.: 10/808,096

(22) Filed: Mar. 24, 2004

Related U.S. Application Data

(60) Provisional application No. 60/458,135, filed on Mar. 27, 2003.

(51) Int. Cl.
*E03D 11/00* (2006.01)

(52) U.S. Cl. ..... 4/255.11; 4/255.01

(58) Field of Classification Search ..... 4/255.01, 4/255.05, 255.08, 255.11, 255.12
See application file for complete search history.

(56) References Cited

U.S. PATENT DOCUMENTS 2,126,689 A * 8/1938 Pouliot ..... 4/255.11
2,195,830 A * 4/1940 Schubring ..... 4/255.11
D159,726 S * 8/1950 Grosvold ..... D32/35
3,021,532 A * 2/1962 Gross ..... 4/255.11
3,336,604 A * 8/1967 Lacey et al. ..... 4/255.11
5,384,918 A * 1/1995 Leighton et al. ..... 4/255.05
6,032,301 A 3/2000 Wang
6,035,455 A 3/2000 Rankovic
6,393,626 B1 5/2002 Dhillon

* cited by examiner

*Primary Examiner*—Justine R. Yu
*Assistant Examiner*—Huyen Le

(57) ABSTRACT

A plunger for forcing a blockage through a trap of a toilet. The plunger includes a handle member being designed for being gripped by a hand of a user, a plunger portion is coupled to the handle member. The plunger portion is designed for being positioned in the bowl of the toilet. The plunger portion is designed for forcing fluid down a trap of the toilet to force debris, lodged in the trap, through the trap to allow the bowl of the toilet to drain.

1 Claim, 3 Drawing Sheets

PLUNGER

This application claims the benefit of Provisional Application No. 60/458,135 filed Mar. 27, 2003.

BACKGROUND OF THE INVENTION

1. Field of the Invention

The present invention relates to plungers and more particularly pertains to a new plunger for forcing a blockage through a trap of a toilet.

2. Description of the Prior Art

The use of plungers is known in the prior art. U.S. Pat. No. 6,035,455 describes a device for using an actuated air cylinder to force air into a trap to clear debris from the trap. Another type of plunger is U.S. Pat. No. 6,393,626 having a valve positioned in a plunger to allow fluid to be drawn into the plunger from outside of the plunger and then forced by the plunger into the trap of the toilet to clear a blockage from the trap. U.S. Pat. No. 6,032,301 has a plunger with pressure ball capable of being filled with air under pressure and storing the pressurized air for a concentrated release through a correlative shaft to clear a blockage from a pipe.

While these devices fulfill their respective, particular objectives and requirements, the need remains for a device that has certain improved features provides for increased pressure and speed of fluid to clear a blockage without external fluid sources.

SUMMARY OF THE INVENTION

The present invention meets the needs presented above by plunger portion with a bulb member and a sleeve member where the sleeve member has a diameter less than a diameter of the bulb member and thereby accelerates the fluid exiting the bulb to facilitate forcing the debris through the trap in the toilet.

Still yet another object of the present invention is to provide a new plunger that provides a sleeve member that can extend into the trap of the toilet to facilitate directing the force of the fluid into the trap.

Even still another object of the present invention is to provide a new plunger that provides the sleeve member with a plurality of annular rings to form a seal between the sleeve member and the trap to inhibit fluid blowing back between the sleeve member and the trap when the bulb member is compressed.

To this end, the present invention generally comprises a handle member being designed for being gripped by a hand of a user, a plunger portion is coupled to the handle member. The plunger portion is designed for being positioned in the bowl of the toilet. The plunger portion is designed for forcing fluid down a trap of the toilet to force debris, lodged in the trap, through the trap to allow the bowl of the toilet to drain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
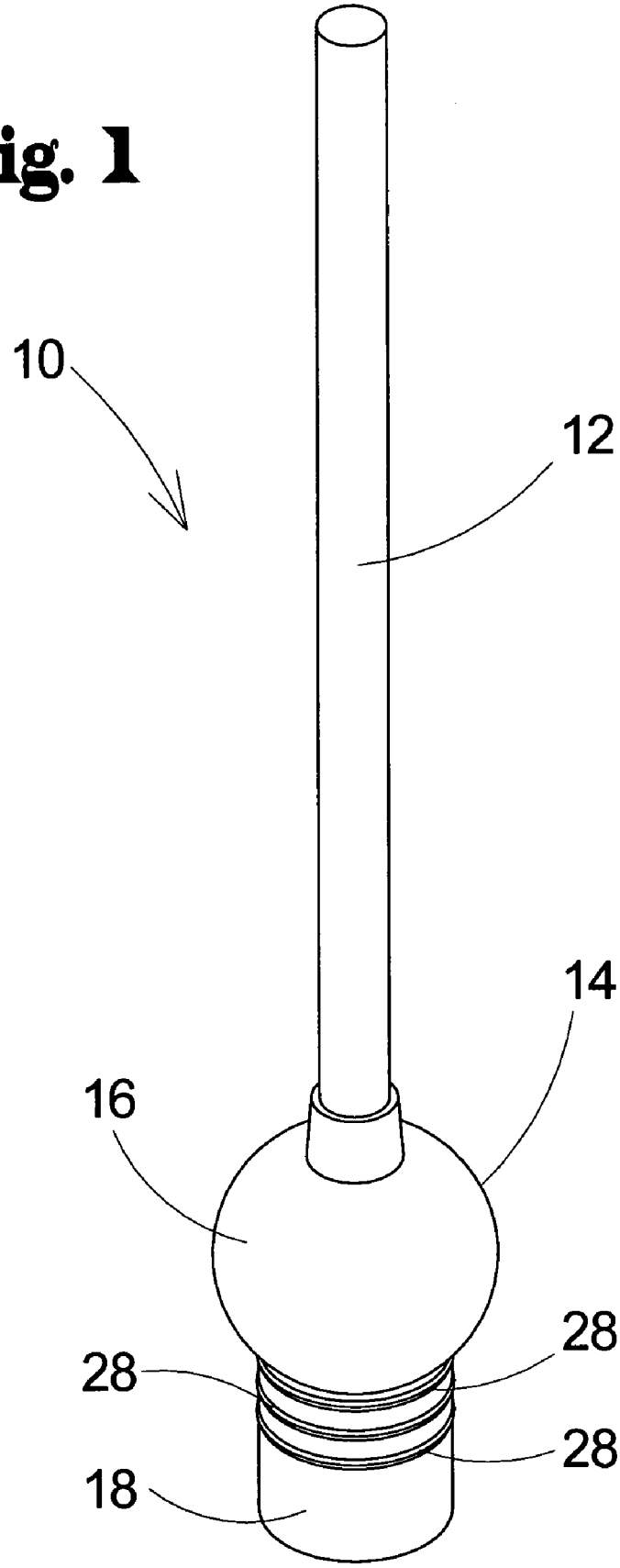
FIG. 1 is a perspective view of a new plunger according to the present invention.
Figure 2:
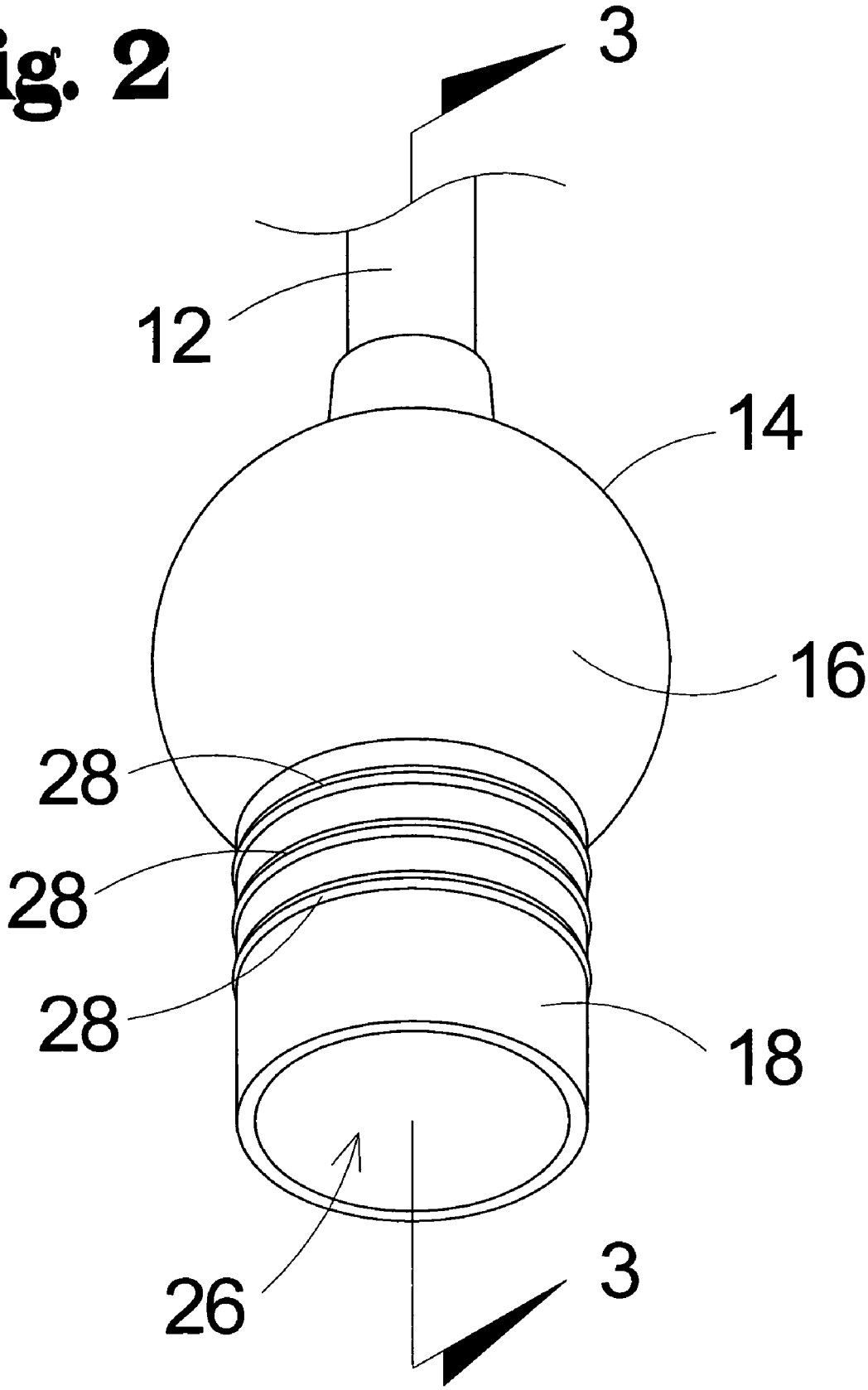
FIG. 2 is an enlarged perspective view of the plunger portion of the present invention.
Figure 3:
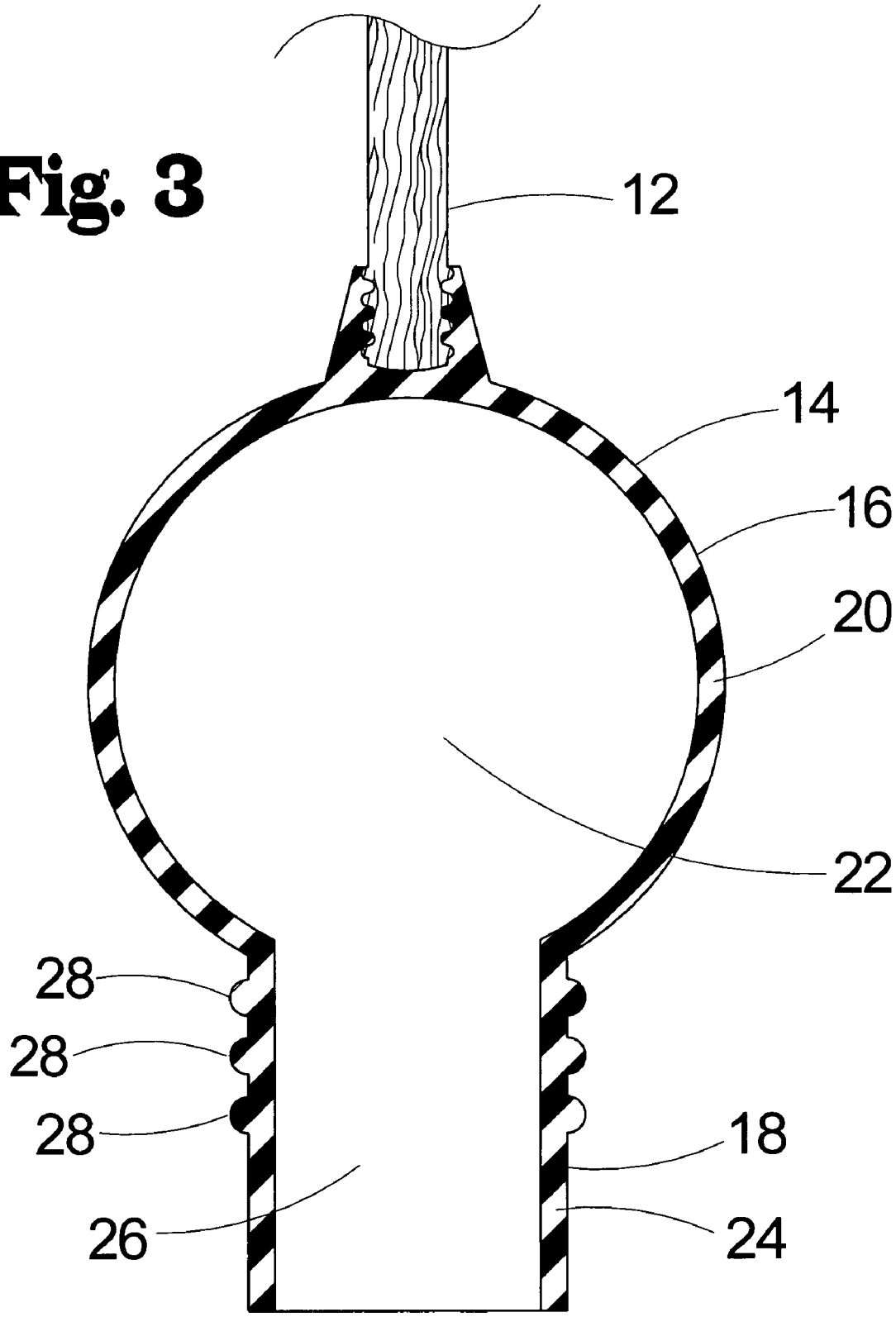
FIG. 3 is a cross-sectional view of the present invention taken along line 3—3 of FIG. 2.

With reference now to the drawings, and in particular to FIGS. 1 through 3 thereof, a new plunger embodying the principles and concepts of the present invention and generally designated by the reference numeral 10 will be described.

As best illustrated in FIGS. 1 through 3, the plunger 10 generally comprises a handle member 12 being designed for being gripped by a hand of a user.

A plunger portion 14 is coupled to the handle member 12. The plunger portion 14 is designed for being positioned in the bowl of the toilet. The plunger portion 14 is designed for forcing fluid down a trap of the toilet to force debris, lodged in the trap, through the trap to allow the bowl of the toilet to drain. The plunger portion 14 comprises a flexible material for permitting the plunger portion 14 to conform to the trap and direct the fluid into the trap.

The plunger portion 14 comprises a bulb member 16 and a sleeve member 18. The sleeve member 18 is coupled to the bulb member 16 whereby the sleeve member 18 is in fluid communication with the bulb member 16. The bulb member 16 is coupled to the handle member 12 whereby the handle member 12 is for forcing fluid in the bulb member 16 through the sleeve member 18 and into the trap of the toilet to force the debris through the trap of the toilet.

The bulb member 16 comprises a perimeter wall 20. The perimeter wall 20 defines an interior space 22 of the bulb member 16. The interior space 22 of the bulb member 16 is designed for containing a fluid to be forced through the trap of the toilet when the bulb portion is compressed by the handle member 12 being actuated by the user.

The sleeve member 18 comprises a peripheral wall 24. The peripheral wall 24 defines a bore 26 extending through the sleeve member 18 whereby the bore 26 is in fluid communication with the interior space 22 of the bulb member 16. The bore 26 is designed for directing the fluid from the bulb member 16 down the trap of the toilet to force the debris through the trap.

The bulb member 16 comprises a latitudinal diameter of about 5¼ inches and a longitudinal diameter of about 12½ *inches*. T*he* sleeve member 18 comprises a length of about 3½ inches and a diameter of about 3 inches. The decrease in diameter between the bulb member 16 and the sleeve member 18 produces an effect similar to a nozzle and forces the fluid from the bulb member 16 through the sleeve member 18 at an increased pressure to facilitate forcing the debris through the trap of the toilet.

The plunger portion 14 comprises a plurality of annular rings 28, each of the annular rings 28 outwardly extends from the sleeve member 18 whereby each of the annular rings 28 is positioned substantially perpendicular to a longitudinal axis of the plunger portion 14. The annular rings 28 are designed for engaging the surface of the bowl to provide a seal between the sleeve member 18 and the bowl of the toilet to inhibit the fluid forced from the bulb member 16 from blowing back between the sleeve member 18 and the bowl of the toilet.

In use, the user insert the plunger portion 14 into the bowl of the toilet so that sleeve is inserted into the opening for the trap of the toilet. The user then forces the handle member 12 downward which compresses the bulb member 16 and forces the fluid in the bulb member 16 through the sleeve member 18 and into the trap to force the debris through the trap and allow the bowl of the toilet to drain. The process is repeated until the blockage has been removed and normal operation of the toilet can resume.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plunger for forcing debris through a trap of a toilet, the plunger comprising:

a handle member is adapted for being gripped by a hand of a user; and a plunger portion being coupled to said handle member, said plunger portion being adapted for being positioned in the bowl of the toilet, said plunger portion being adapted for forcing a fluid down the trap of the toilet to force debris through the trap to allow the bowl of the toilet to drain;

said plunger portion comprising a bulb member and a sleeve member united together, said sleeve member having an interior in fluid communication with an interior of said bulb member, said bulb member being coupled to said handle member;

said bulb member being defined by a substantially spherical bulb wall and said sleeve member being defines by a substantially cylindrical sleeve wall extending from said bulb wall at a juncture, said sleeve wall terminating at a substantially circular end opening;

said substantially cylindrical sleeve wall having a uniform diameter from said juncture with said substantially spherical bulb wall to said end opening of said sleeve wall;

wherein said plunger portion comprises a flexible material, said flexible material being for permitting said plunger portion to conform to the trap and direct said fluid into the trap;

wherein said sleeve member has a diameter less than a diameter of said bulb member;

wherein said plunger portion comprises a plurality of annular rings, each of said annular rings outwardly extending from said sleeve member such that each of said annular rings is positioned substantially perpendicular to a longitudinal axis of said plunger portion, said annular rings are adapted for engaging the surface of the bowl to provide a seal between said sleeve member and the bowl of the toilet to inhibit the fluid forced from said bulb member from blowing back between said sleeve member and the bowl of the toilet;

wherein each ring of said plurality of rings is substantially uniformly spaced from another ring of said plurality of rings;

wherein said bulb wall has a substantially spherical interior surface and a substantially spherical exterior surface;

wherein said sleeve wall has a substantially cylindrical interior surface and a substantially cylindrical exterior surface.

* * * * *